United States Patent [19]

Trinh et al.

[11] Patent Number: 4,692,571

[45] Date of Patent: Sep. 8, 1987

[54] PANEL ASSEMBLY WITH EASILY DETACHABLE SWITCH ACTUATORS

[75] Inventors: Vinh-Dinh D. Trinh, Arlington Heights; Ronald P. Scholtes, Cary; Terence E. Sumner, Roselle, all of Ill.

[73] Assignee: Motorola, Inc., Schaumberg, Ill.

[21] Appl. No.: 902,909

[22] Filed: Sep. 2, 1986

[51] Int. Cl.[4] ..... H01H 9/02

[52] U.S. Cl. ..... 200/5 A; 200/307; 361/399

[58] Field of Search ..... 200/5 A, 307; 361/346, 361/380, 395, 399

[56] References Cited

U.S. PATENT DOCUMENTS

| | | | |
|---|---|---|---|
| 3,900,712 | 8/1975 | Fukao | 200/307 |
| 4,303,811 | 12/1981 | Parkinson | 200/5 A |
| 4,403,122 | 9/1983 | Wise | 200/5 A |
| 4,417,105 | 11/1983 | Glaser | 200/5 A |
| 4,464,550 | 8/1984 | Soes | 200/153 LA |
| 4,540,858 | 9/1985 | Knoop | 200/5 R |

FOREIGN PATENT DOCUMENTS

| | | | |
|---|---|---|---|
| 700496 | 12/1953 | United Kingdom | 200/307 |

*Primary Examiner*—A. D. Pellinen
*Assistant Examiner*—Morris Ginsburg
*Attorney, Agent, or Firm*—Donald B. Southard; Anthony J. Sarli, Jr.

[57] ABSTRACT

A control or front panel assembly which is suitable for inclusion in associated apparatus. The panel assembly includes a switching arrangement with individual switch actuators easily detachable and removable during final assembly prior to mounting an escutcheon plate to the front panel face. In this manner, a single piece part need only be inventoried, modifiable during final assembly, to effect the desired model variations for the associated apparatus.

14 Claims, 5 Drawing Figures

PANEL ASSEMBLY WITH EASILY DETACHABLE SWITCH ACTUATORS

BACKGROUND OF THE INVENTION

This invention relates generally to panel assemblies with switch actuators for selecting available options provided by the associated electrical/electronic apparatus and, more particularly, to a universal control panel assembly adaptable at final assembly to any variation of selectable options thereby permitting stockage of a single piece part to be used in the various configurations made available.

It is common practice for a manufacturer of a product to provide certain model variations of that product to meet the market demand. This is true regardless of the nature of the product, be it mechanical, electrical or electronic in nature. These model variations are needed to accommodate the various options that the manufacturer perceives to be in demand.

Usually such model variations necessitate the stocking in inventory of all of the different piece parts comprising the different models. This is particularly so with regard to electronic apparatus which conventionally is rich in options available from the manufacturer. This requires that the manufacturer not only stock different component parts in inventory, but to coordinate the location and availability of the same for use during final assembly. It makes it particularly difficult to effect the special operations for those non-standard orders or custom products. The model assembler must first identify the particular component parts necessary, from drawings, parts list or the like. Then he or she must physically obtain them and, finally, assemble them in the correct sequence, all of which may be reasonably unfamiliar to him or her because of the special or custom aspect thereof.

In any event, the stocking of the differing piece parts for each model variation necessarily adds substantially to the overall manufacturing costs. What is needed is a manner and/or means to reduce the necessary component parts. It would not only reduce stocking requirements but would provide for more efficient assemblage by reason of the fact that the worker could gain more proficiency in the fabrication of the models being offered.

SUMMARY OF THE INVENTION

It is the general object of the present invention to reduce the inventory stockage necessary for assembling various product variations.

A more particular object of the present invention is to provide a single, universal, piece part, or assemblage, modifiable at final assembly with a minimum number of additional component parts to effect the desired model variations.

In practicing the invention, a universal control or front panel with a switching arrangement adaptable at final assembly is provided to accommodate those selectable options effected by an associated PC board. A control panel housing is provided for mounting the associated PC board and an elastomeric key strip assembly between the PC board and the housing front panel. The key strip assembly has a plurality of switch actuators extending through associated openings in the housing panel and are accessible to the user. Each of these switch actuators are selectably and individually detachable by grasping and pulling the same through the front panel openings so that the remaining switches conform to the options provided by the PC board. An escutcheon plate may then be mounted to the front of the housing to accommodate the remaining switches, cover any holes caused by switch removal and also identify the options provided along with other desired information.

BRIEF DESCRIPTION OF THE DRAWINGS

The features of the present invention which are believed to be novel are set forth with particularity in the appended claims. The invention itself, together with further objects and advantages thereof, may be best understood by reference to the following description taken in connection with the accompanying drawings, in the several figures of which a like reference numeral identify like elements, and in which:

DESCRIPTION OF THE PREFERRED EMBODIMENT

Figure 1:
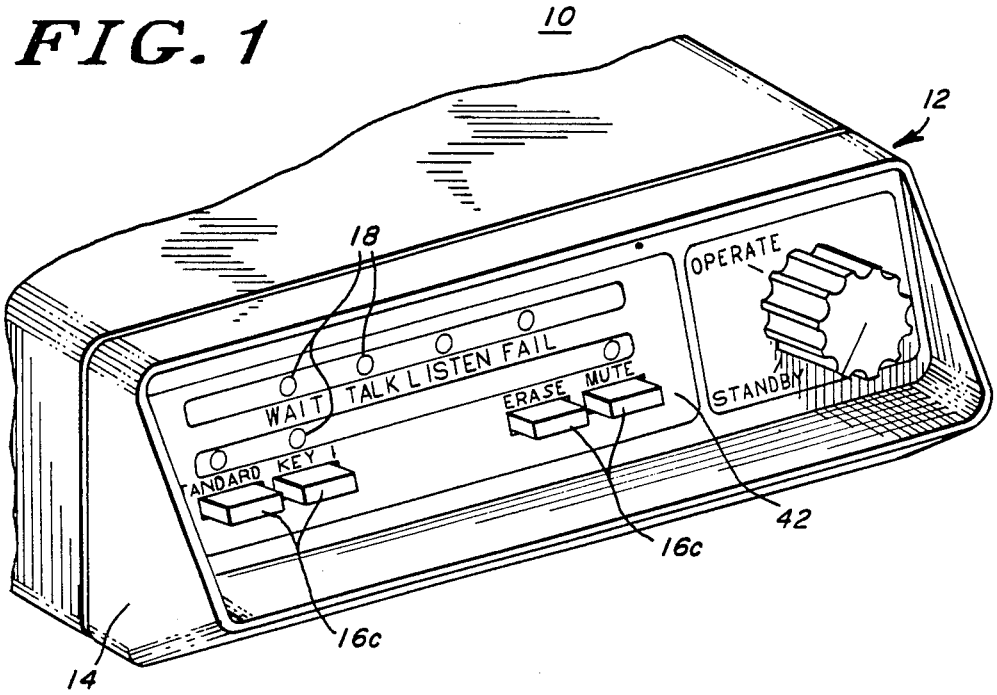
FIG. 1 is an enlarged fragmentary view in perspective of an electronic apparatus having a front panel which incorporates the present invention.

Referring now to the drawings, a portion of the electrical/electronic apparatus or terminal 10 is shown in perspective in FIG. 1 which includes at least the control or front panel assembly 12 thereof. It should be noted that the particular type of product is not important in which the present invention may be implemented. A wide variety of products are relevant and contemplated. However, for illustrative purposes only, the product in which the invention is implemented and disclosed in specifications and the drawings herein is a telephone terminal useful in a secure telephone communication system.

The terminal 10 includes a front panel housing 14. Protruding from the face thereof ia a plurality of switch bars 16*c* of associated actuator or switch assemblies 16. These actuators extend through appropriate openings in the front panel, as illustrated, and are accessible to the user. They are activated by depressing inwardly to make contact with associated switching elements internal to the assembly 12 as will as described subsequently. Also included in the front panel assembly is a series of panel lights 18 which may be selectively operable or energized, by the switch assemblies 16 or by circuit function of the terminal 10 itself, to indicate what mode or feature has been selected or is in present operation.

Figure 2:
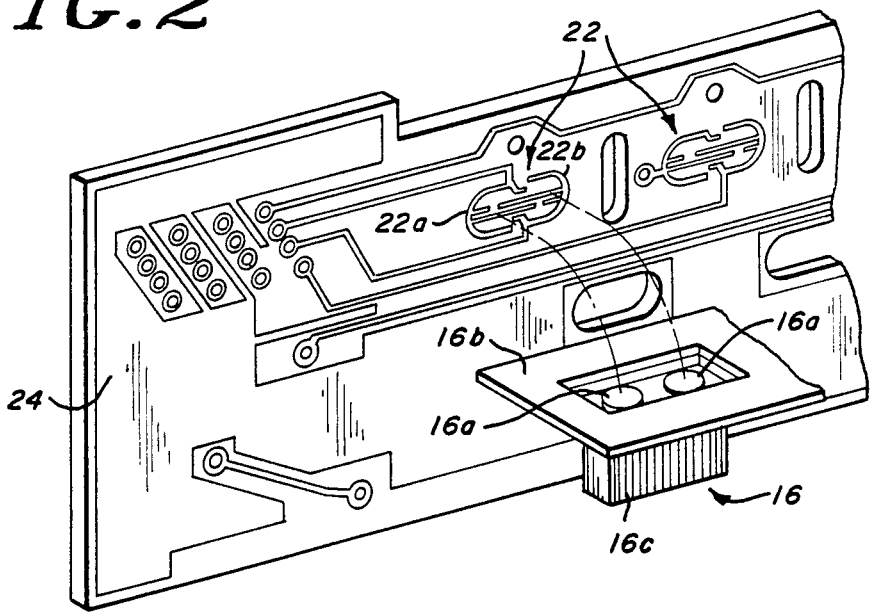
FIG. 2 is an enlarged fragmentary view in elevation of the associated PC board included in the front panel of FIG. 1 and an associated switch actuator.

These panel lights 18 (not specifically shown) along with switch elements 22 that are contacted by the actuator 16, are included on an associated printed circuit board 24, as shown in FIG. 2. These switch elements include respective halves 22*a* and 22*b* in the form of conductive runners plated on the PC board 24 itself. They are bridged, i.e. contacted, by conductive pads 16*a* on actuators 16 when pressed inwardly by a user's finger at the front panel location. The necessary flexibility for actuators 16 as provided by the base portion **16*b* thereof, being fabricated from a suitable elastomeric and resilient material in the form of a flat thin sheet or web, thereby permitting substantial travel for the actuator bar 16*c* in the lateral direction to and from contact with switching elements 22*a* and 22*b*. There are two conductive contact pads 16*a*, as shown, to insure the appropriate switching action takes place regardless of how the actuator bar 16 is pushed in. In other words, it can be tilted to one side or the other and one of the contact pads 16*a* will effectively bridge a portion of the contact elements 22*a* and 22*b***.

Figure 3:
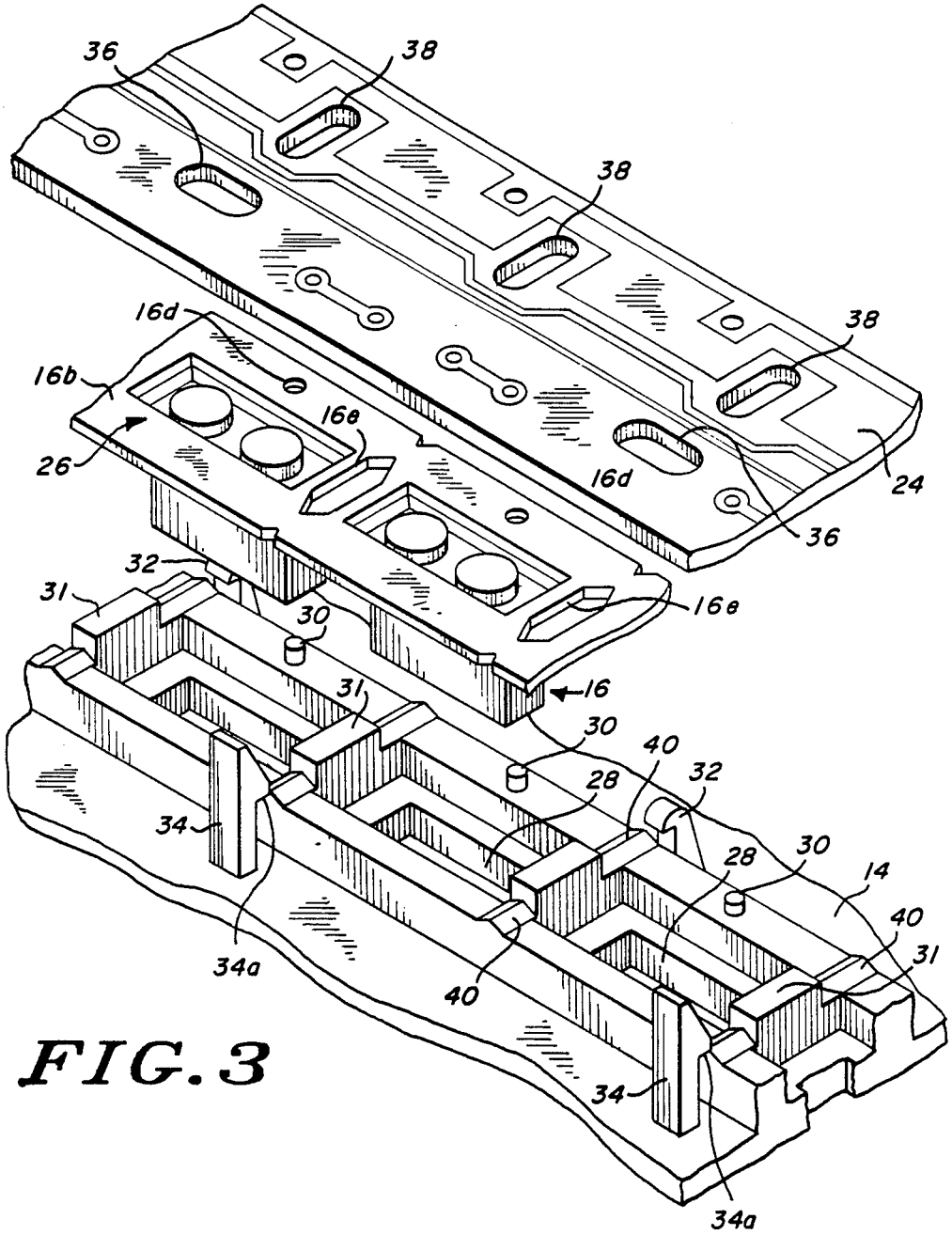
FIG. 3 is an enlarged exploded view of a portion of the front panel assembly which accommodates the elastomeric key switch assembly and associated PC board.

As best shown in FIG. 3, switch actuators 16 are provided in a configuration wherein the base portions **16*b* are connected together to form a single integral unit or assembly identified at 26. As many switch actuators can be connected together as desired. By way of illustration, there are six such actuators interconnected in the present application because that is the maximum number of selectable options provided for in apparatus 10 (see FIG. 5**). While it is shown in the drawings that a plurality of switch actuators are interconnected in a single row, there could be multiple rows as well, and all such configurations are in fact contemplated by the present invention.

In assembly, the elastomeric key-strip assembly 26 with all six switch actuators 16 interconnected is dropped into the back of front panel housing 14 as a unit with each such actuator 16 extending through an appropriate opening 28 in panel housing 14, as particularly depicted in FIG. 3. An allignment peg or pin 30, extending outwardly from panel housing 14 inserts in an appropriate opening **16*d* of end base 16*b* of each actuator 16. A larger, rectangular shaped bar 31 also extends outwardly in the same fashion and is intended to extend through the hexagonal shaped opening 16*e* positioned between adjacent base element 16*c***, as illustrated.

After the key switch assembly 26 has been inserted in the manner described, the associated PC board 24 is placed on top of assembly 26 by inserting an edge thereof under hook members 32 extending upwardly from the back of panel housing 14. The PC board is then pushed downwardly along the opposite edge to force slant faced hook members 34 into and through matching openings or slots 36 on the board 24. The overhanging latch portion **34*a* then overlies a portion of the PC board 24 to captivate the same and the key switch assembly 26** underneath thereof.

It should also be noted that rectangular shaped bars 31 align with and extend into mating openings 38 in PC board 24. These do not only help align and maintain the PC board in its desired location, but also permits board 24 to press downwardly on key switch assembly 26 and hold the base sheet **16*b* firmly on the triangular or inverted V-shaped rib members 40**, the function of which will be described in more detail subsequently.

The final assembly step is to place an escutcheon plate 42 on the front panel 12. The plate 42 may be conveniently affixed to panel face by an adhesive material or the like. If the maximum number of options or features are being provided by apparatus 10, all six switch actuators 16 will be utilized and will appear as that shown in FIG. 5. However, if less than the maximum number of features is being offered, say for example, four, as depicted in FIG. 1, the escutcheon plate 42 needed to reflect that circumstance, and, more importantly, the two superfluous switch actuators 16 must be moved.

This can be easily effected in accordance with the present invention by grasping each of the switch actuators 16 one at a time by hand, or with a tool, such as pliers, and exerting sufficient pulling force to break away the actuator 16 at its base 16b and permit the actuator 16 to be pulled through its associated panel opening 28. With the two switch actuators 16 removed, the escutcheon plate 42 may be affixed to the front face of panel 12.

Figure 4:
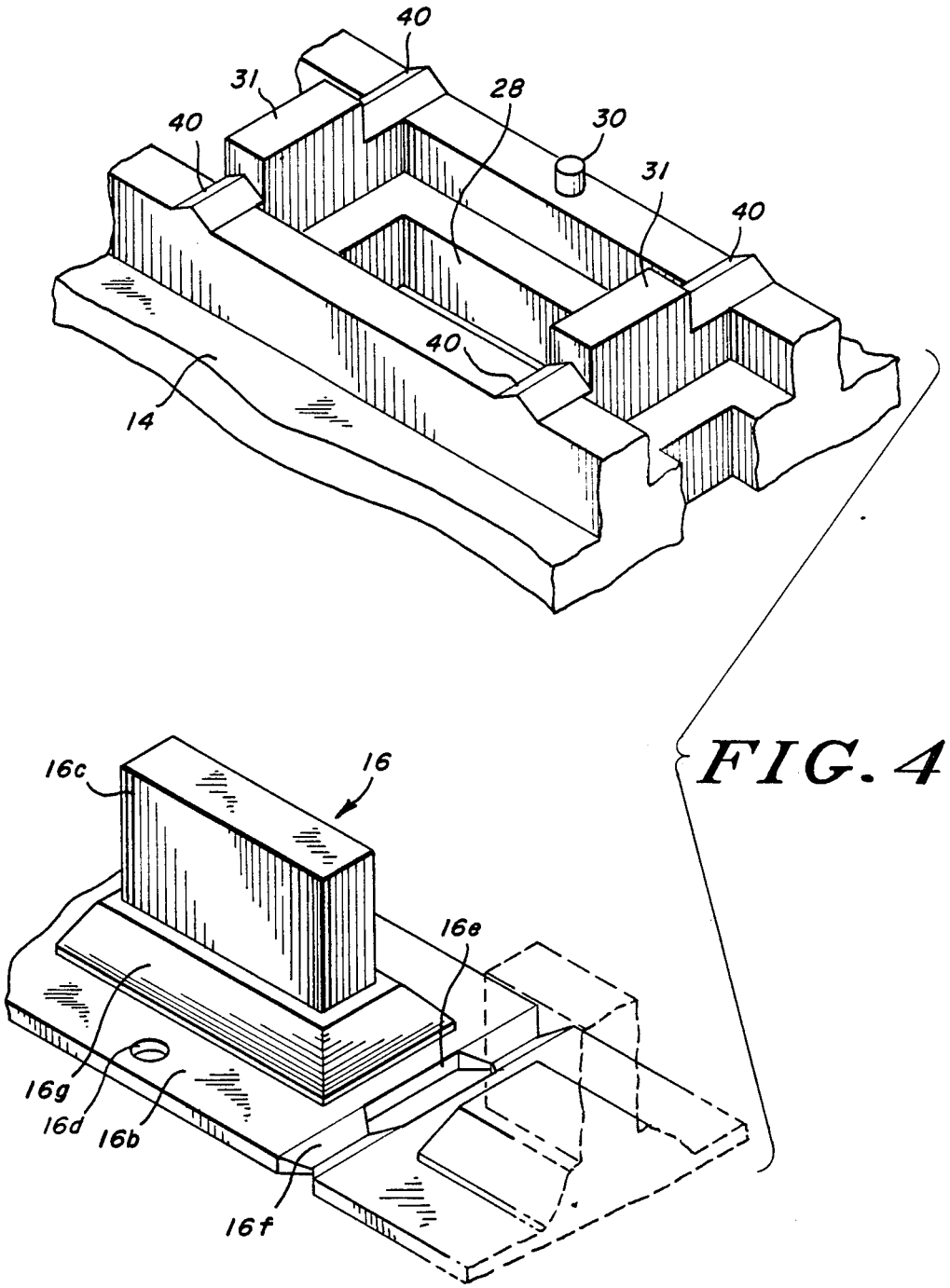
FIG. 4 is an enlarged fragmentary, in exploded view, of an associated switch actuator and a portion of the front panel assembly cooperating therewith.

This breakaway action of switch actuator 16 may be more easily appreciated by reference to FIG. 4. The one-piece base webbing **16*b* includes a channel or groove 16*f* of reduced thickness between each of the actuator 16 which aligns with the raise, inverted V-rib 40 on the panel housing 14. This V-rib, or more accurately, the knife edge thereof, acts as a shear assist when actuator 16 is being pulled or extracted from the front through opening 28. It is to be emphasized that this reduced thickness portion 16*f* is an aspect of the preferred embodiment. It can be omitted if desired. In this case, the shearing actions may not be along the same or precise line as represented by portion 16*f*. The pins 30, collectively, serve to hold the adjacent actuator 16 in place while the selected one is being suitably extracted. To further assist the removal of the particular actuator 16, a sloping ramp 16*g* is provided at the lower end of actuator bar 16*c* to help guide the structure being extracted through the panel opening 28**.

In this manner, it is insured that a high enough force is required to prevent actuator 16 from being accidentally removed or extracted, yet low enough for the assembler of the product to make the necessary and desired modifications practical and conveniently effected.

Figure 5:
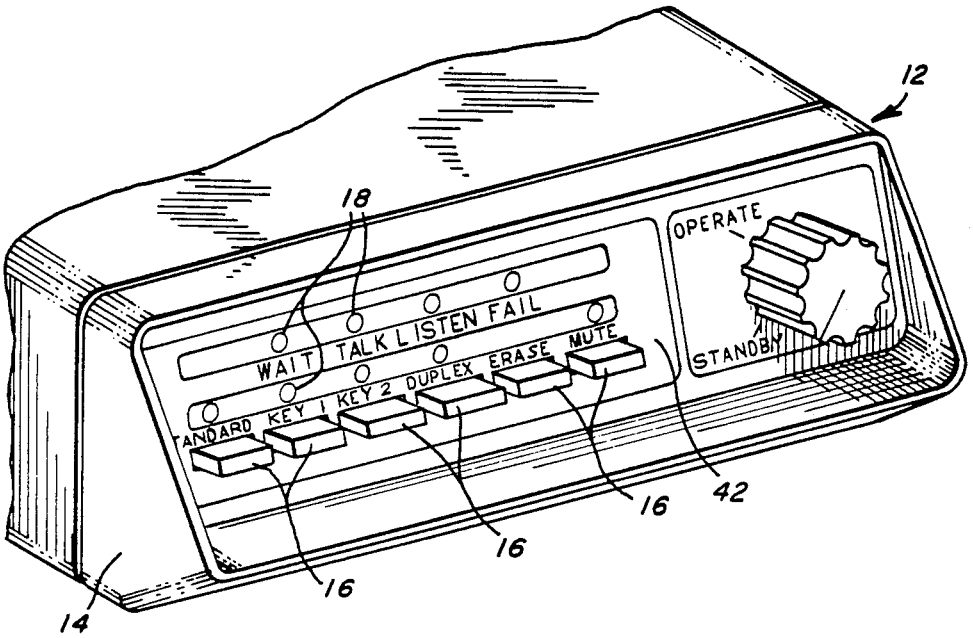
FIG. 5 is a fragmentary view of the electrical apparatus of FIG. 1 which includes all available options offered in this model variation.

As may be readily appreciated, this permits the manufacturer of the electrical/electronic apparatus 10 to stock only a single front panel assemblage containing all the switch actuator 16, such as depicted in FIG. 5. Eight (in this case) separate variations need not be maintained in inventory for this piece part. The eight possible model variations are then effected during final assembly by simple extracting and discarding the unwanted switch actuator(s) 16. After the particular actuator 16 is removed, the correct escutcheon plate 42 is then put in place on the front panel covering any unwanted switch position holes, as depicted in FIG. 1.

By eliminating the requirement of having to build all the variations of front panel sub-assemblies, substantial savings in time and money can be readily realized, not to mention the reduced stocking and inventory requirements as well as space for the inventory. In accordance with this invention, only a single piece part need be fabricated and stocked, with the exception of the individual escutcheon plate, under a single part number.

While only particular embodiments of the invention have been shown and described herein, it will be obvious that certain modifications being made without departing from the invention in its broader aspects and, accordingly, the appended claims are intended to cover all such changes and alternative constructions that fall within the true scope and spirit of the invention.

What is claimed is:

1. A universal control panel assembly with a switching arrangement adaptable at final assembly to accommodate only those selectable option features provided by an associated PC board, comprising in combination:

a control panel housing with means for mounting the associated PC board;

an elastomeric key strip assembly having multiple switch assemblies with associated breakaway switch actuators mounted between said housing and PC board with each of said switch actuators extending through an associated opening in said housing and accessible to a user, said switch actuators being selectively and individually detachable by being pulled through said panel openings so that the remaining switch assemblies conform to the options provided by said PC board; and an escutcheon plate mounted to the front of said housing to accommodate the remaining switch actuators and identify the options selectable.

2. A universal control panel assembly in accordance with claim 1 wherein said breakaway switch actuators are detachably connected together by a base strip of flexible webbing.

3. A universal control panel assembly in accordance with claim 2 wherein said webbing includes a reduced thickness portion between successive actuators, which portions are aligned with a respective inverted V-rib on said housing to provide a shear assist when extracting a selected actuator.

4. A universal control panel assembly in accordance with claim 2 wherein guide pins are included on said housing to align and mate with corresponding openings on said key strip assembly to hold and maintain the remaining actuators in place while a selected one thereof is being extracted.

5. A universal control panel assembly in accordance with claim 1 wherein the mounted said printed circuit board and key strip assembly includes one or more hook members on the panel housing overlying an edge portion on one side of said PC board and one or more complementary hook members extending through and latching in corresponding opening along the other edge of said PC board.

6. A universal control panel assembly in accordance with claim 1 wherein switching elements in the form of conductive runners are provided on said printed circuit board which are to be bridged across by at least one conductive pad on one of said actuator when the same is actuated by being depressed inwardly.

7. A universal control panel assembly in accordance with claim 6 wherein said actuator includes first and second conductive pads for contacting said switching elements on said printed circuit board.

8. A front panel assembly modifiable at final assembly and intended for inclusion with associated electrical apparatus, comprising in combination:

a printed circuit board;

a control panel housing with means for mounting the associated PC board; and an elastomeric key strip assembly having multiple switch assemblies with associated breakaway switch actuators mounted between said housing and PC board with each of said switch actuators extending through an associated opening in said housing for accessibility by a user, said switch actuators being selectively and individually detachable by being pulled through said panel openings so that the remaining switch assemblies conform to the options provided by said PC board.

9. A modifiable front panel assembly in accordance with claim 8 wherein said breakaway switch actuators are detachably connected together by a base strip of flexible webbing.

10. A modifiable front panel assembly in accordance with claim 9 wherein said webbing includes a reduced thickness portion between successive actuators which portions are aligned with a respective inverted V-rib on said housing to provide a sheer assist when extracting a selected actuator.

11. A modifiable front panel assembly in accordance with claim 9 wherein guide pins are included on said housing to align and mate with corresponding openings on said key strip assembly to hold and maintain the remaining actuators in place while a selected one thereof is being extracted.

12. A modifiable front panel assembly in accordance with claim 8 wherein the mounted said printed circuit board and key strip assembly includes one or more hook members on the panel housing overlying an edge portion on one side of said PC board and one or more complementary hook members extending through and latching in corresponding opening along the other edge of said PC board.

13. A modifiable front panel assembly in accordance with claim 8 wherein switching elements in the form of conductive runners are provided on said printed circuit board which are to be bridged across by at least one conductive pad on one of said actuators when the same is actuated by being depressed inwardly.

14. A modifiable front panel assembly in accordance with claim 13 wherein said actuator includes first and second conductive pads for contacting said switching elements on said printed circuit board.

* * * * *